US011027900B2

(12) United States Patent
Liu

(10) Patent No.: US 11,027,900 B2
(45) Date of Patent: Jun. 8, 2021

(54) CAP CLOSING STRUCTURE FOR SEALED CONTAINER

(71) Applicants: FREE-FREE(USA) INC, Ontario, CA (US); FREE-FREE INDUSTRIAL CORP, Taipei (TW)

(72) Inventor: Sheng-Yu Liu, Taipei (TW)

(73) Assignees: FREE-FREE(USA) INC, Ontario, CA (US); FREE-FREE INDUSTRIAL CORP, Taipei (TW)

( * ) Notice: Subject to any disclaimer, the term of this patent is extended or adjusted under 35 U.S.C. 154(b) by 151 days.

(21) Appl. No.: 16/269,554

(22) Filed: Feb. 6, 2019

(65) Prior Publication Data

US 2020/0247598 A1 Aug. 6, 2020

(51) Int. Cl.
*B65D 53/00* (2006.01)

(52) U.S. Cl.
CPC .... *B65D 53/00* (2013.01); *B65D 2543/00537* (2013.01)

(58) Field of Classification Search
CPC ..... B65D 53/00; B65D 41/0471; B65D 2543/00537; B65D 41/0485; B65D 41/36; B65D 41/365; B65D 41/06; B65D 41/065
See application file for complete search history.

(56) References Cited

U.S. PATENT DOCUMENTS 326,641 A * 9/1885 Guptill ..... B65D 39/12 215/359
634,240 A * 10/1899 Hoyt ..... B65D 39/12 215/359
2,822,108 A * 2/1958 Moeller ..... B63B 43/16 220/238
3,087,641 A * 4/1963 Millard ..... E05D 11/0054 220/238
3,093,220 A * 6/1963 Modrey ..... F16B 5/0642 403/408.1

(Continued)

FOREIGN PATENT DOCUMENTS

CN 206782409 U 12/2017
EP 2174882 B1 11/2011

OTHER PUBLICATIONS

Office Action dated Sep. 2, 2020 of the corresponding United Kingdom patent application No. 1912358.7.

*Primary Examiner* — Nathaniel C Chukwurah
*Assistant Examiner* — Lucas E. A. Palmer
(74) *Attorney, Agent, or Firm* — Chun-Ming Shih; HDLS IPR Services

(57) ABSTRACT

A cap closing structure for a sealed container includes an upper cover, a lower cover, an elastic element and a handle member. The upper cover includes a top plate having a through hole and a circumferential bracket having a retaining slanted surface. The lower cover underneath the upper cover includes a base plate having a latch member penetrating into the through hole and a sealing ring. The latch member includes a guiding structure. One end of the sealing ring is at outer side of the retaining slanted surface. The elastic element is mounted onto the latch member and clamped between the top and base plates. The handle member includes a dial lever and an arm with a shaft operably moving inside the guiding structure for the sealing ring to be sealed between the retaining slanted surface and container.

8 Claims, 8 Drawing Sheets

(56) References Cited

U.S. PATENT DOCUMENTS

| | | | | | |
|---|---|---|---|---|---|
| 3,295,712 | A * | 1/1967 | Peterson | B65D 39/12 | 220/235 |
| 4,993,246 | A * | 2/1991 | Kopper | B65D 39/12 | 292/240 |
| 5,845,800 | A * | 12/1998 | Shaw | B60K 15/0406 | 220/210 |
| 6,276,545 | B1 * | 8/2001 | Ferrari | B65D 45/34 | 215/274 |
| 6,745,914 | B2 * | 6/2004 | Hagano | B60K 15/0406 | 220/203.24 |
| 7,513,381 | B2 * | 4/2009 | Heng | B65D 43/022 | 215/359 |
| 8,186,527 | B2 * | 5/2012 | Liu | B65D 39/12 | 215/317 |
| 9,469,449 | B1 * | 10/2016 | Fields | B65D 43/265 | |
| 10,737,847 | B1 * | 8/2020 | Liu | B65D 43/06 | |
| 2008/0179274 | A1 * | 7/2008 | Cheng | A45F 3/16 | 215/329 |
| 2009/0114653 | A1 * | 5/2009 | Schenker | B65D 45/02 | 220/324 |
| 2011/0036837 | A1 * | 2/2011 | Shang | B65D 45/34 | 220/240 |
| 2012/0012584 | A1 * | 1/2012 | Chameroy | A47J 27/0813 | 220/203.01 |
| 2013/0313219 | A1 * | 11/2013 | Pao | B65D 53/02 | 215/262 |
| 2017/0190479 | A1 * | 7/2017 | Liu | B65D 39/12 | |

* cited by examiner

CAP CLOSING STRUCTURE FOR SEALED CONTAINER

BACKGROUND OF THE INVENTION

Field of the Invention

The technical field relates to a sealed container technique, in particular, to a cap closing structure for a sealed container.

Description of Related Art

A sealed container typically includes a container and a cap for covering onto an opening of the container in an airtight manner. The cap can be detachably covered onto the container. To achieve an airtight sealing of the opening of the container, the bottom edge of the cap is typically installed with a ring gasket in order to allow the gasket to be stacked at the opening of the container in an airtight manner in order to achieve the sealing effect. Since such type of sealing container is likely to be infiltrated by liquid or powder such that the gasket can be dirty or dirt can be accumulated at the gap thereof, and the situation of growing of molds or contamination to food inside the container may even occur, consequently, it requires frequent removal and cleaning. In addition, the gasket and the ring slot needs to be dried before re-assembly for use again, which is extremely inconvenient to users.

To improve the aforementioned drawbacks in prior art, industrial manufacturers have developed a sealing container cap equipped with a handle and an elastic element in the market. Such type of sealing container is to perform pressing operation on the handle and to utilize the elastic reaction force of the elastic element to perform compressive deformation of the gasket in order to achieve the sealing effect. Nevertheless, such type of sealing container often suffers from the problems of unevenly exerted force and inclination during the process of use thereof, such that the sealing effect is reduced.

In view of above, the inventor seeks to overcome the aforementioned drawbacks associated with the currently existing technology after years of research and development along with the utilization of academic theories, which is also the objective of the development of the present invention.

SUMMARY OF THE INVENTION

An objective of the present invention is to provide a cap closing structure for a sealed container, utilizing a latch member formed directly on the lower cover. Consequently, the overall structure is simplified, actuation is stable, and the sealing effect is excellent.

To achieve the aforementioned objective, the present invention provides a cap closing structure for a sealed container, used for attaching onto the container, comprising an upper cover, a lower cover, an elastic element and a handle member. The upper cover comprises a top plate and a circumferential bracket extended from the top plate. The top plate includes a through hole formed thereon, and the circumferential bracket includes a retaining slanted surface formed thereon. The lower cover is arranged underneath the upper cover. The lower cover comprises a base plate and a sealing ring connected to the base plate. The base plate includes a latch member extended to penetrate into the through hole. The latch member includes a guiding structure formed thereon, and the sealing ring includes one end formed at another side of the retaining slanted surface. The elastic element is mounted onto an outer perimeter of the latch member and elastically clamped between the top plate and the bottom plate. The handle member comprises a dial lever and an arm extended from the dial lever, the arm connected to a shaft, and the shaft is configured to operably move inside the guiding structure, thereby allowing the sealing ring to be tightly sealed between the retaining slanted surface and the container.

The present invention further includes the following effects. By configuring the circumferential wall to surround the outer perimeter of the latch member, the stability of the lower cover during the up/down movement can be increased. With a plurality of ribs formed between the outer perimeter of the lower mounting ring and the base plate, the structural strength can be further enhanced. In addition, by forming the lower cover and the handle member as an integral piece respectively, the time required for component assembly can be reduced.

DETAILED DESCRIPTION OF THE INVENTION

Figure 1:
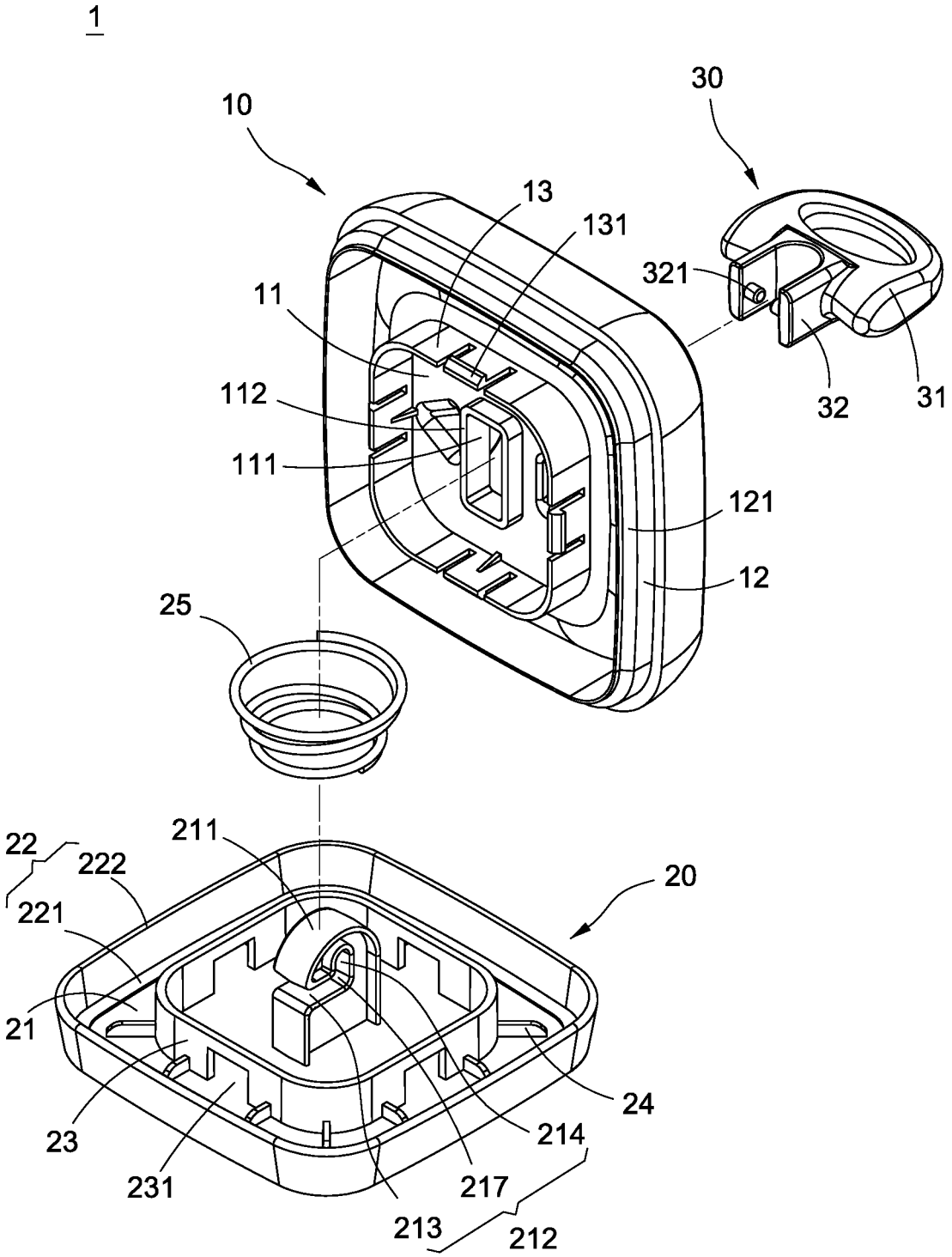
FIG. 1 is a perspective exploded view of a cap closing structure of the present invention.
Figure 2:
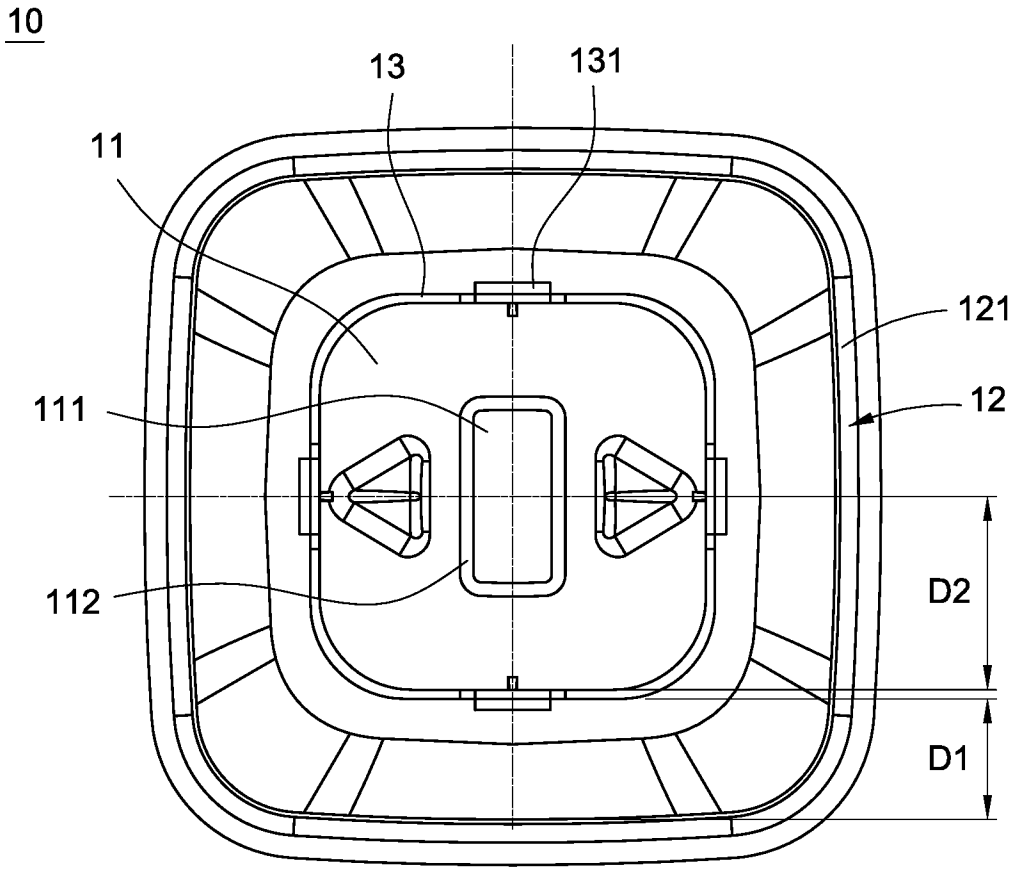
FIG. 2 is a top view of the inner portion of the upper cover of the present invention.
Figure 3:
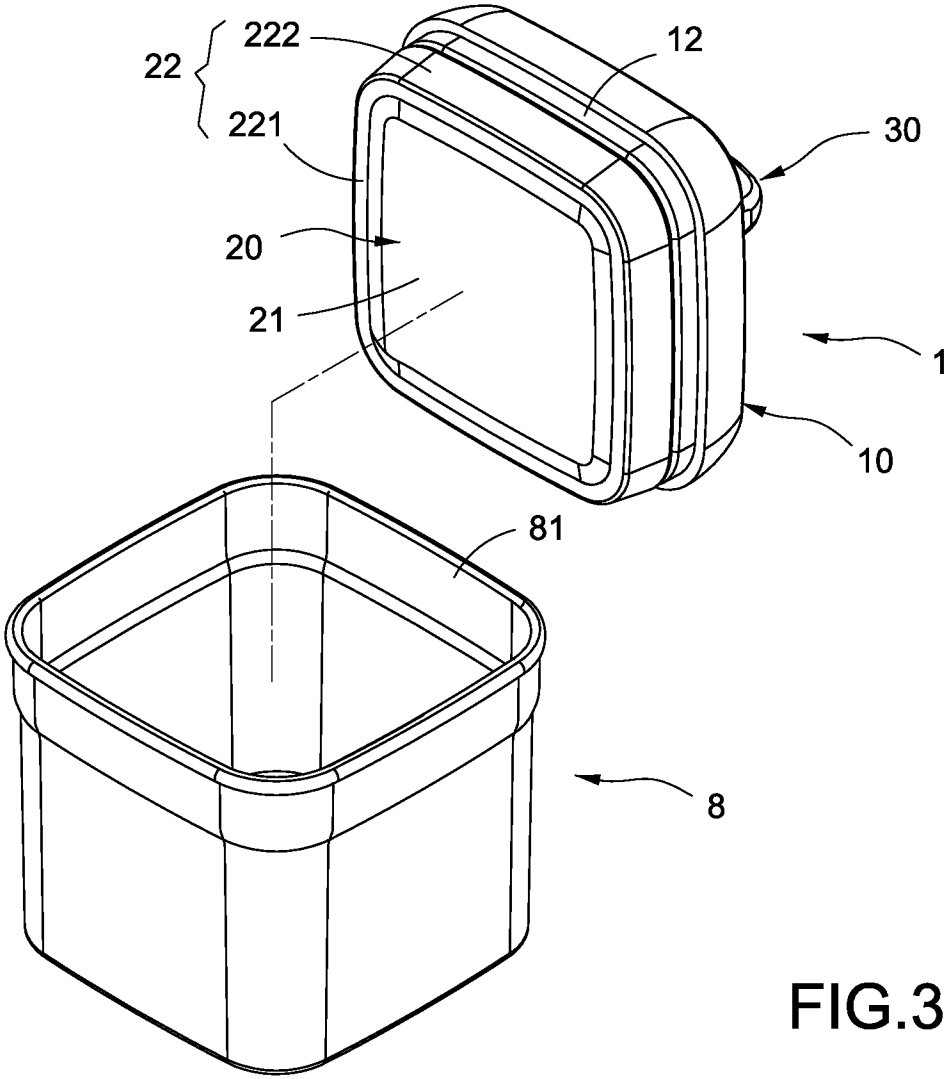
FIG. 3 is a perspective exploded view of the cap closing structure and the container of the present invention.
Figure 4:
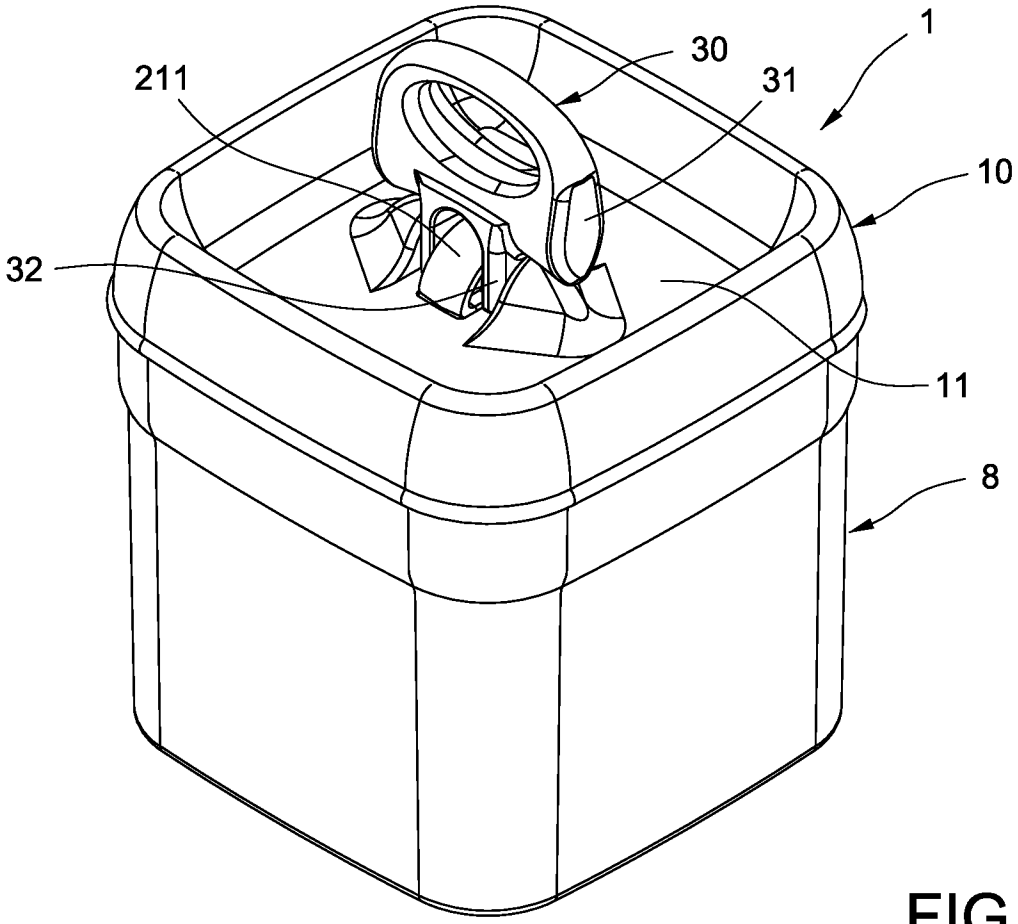
FIG. 4 is an assembly outer appearance view of the cap closing structure and the container of the present invention.

The following provides a detailed technical content of the present invention along with the accompanied drawings. However, the accompanied drawings are provided for reference and illustrative purpose only such that they shall not be used to limit the scope of the present invention.

Please refer to FIG. 1 to FIG. 5. The present invention provides a cap closing structure for a sealed container, used for attaching onto the container 8. The cap closing structure 1 mainly comprises an upper cover 10, a lower cover 20, an elastic element 25 and a handle member 30.

According to an exemplary embodiment, the upper cover 10 is of a rectangular shape; however, it is not limited to such shape only, and it can be made of a plastic material, such as PP. The upper cover 10 mainly comprises a top plate 11 and a circumferential bracket 12 extended from the top plate 11. The center location of the top plate 11 includes a through hole 111 formed thereon and a circumferential wall 112 extended from a perimeter of the through hole 111. The bottom edge of the circumferential bracket 12 includes a retaining slanted surface 121.

In addition, an upper mounting ring 13 is arranged between the circumferential wall 112 and the circumferential bracket 12 and extends from the top plate 11. The central location of each edge plate of the upper mounting 13 includes an elastic hook 131 formed thereon. In addition, a separation distance D1 between the upper mounting ring 13 and the circumferential bracket 12 is smaller than a separation distance D2 between the upper mounting ring 13 and the central line of the top plate 11.

The lower cover 20 is arranged underneath the upper cover 10, and its shape generally corresponds to the upper cover 10. The lower cover 20 can be made of a plastic material, such as ABS. The lower cover 20 comprises a base plate 21 and a sealing ring 22 connected to the base plate 21. The base plate 21 and the sealing 22 can be integrally formed as one single piece via the injection molding formation method. The center location of the base plate 21 includes a latch member 211 extended therefrom to penetrate into the aforementioned through hole 111, and the outer perimeter of the latch member 211 is surrounded by the circumferential wall 112; consequently, the stability of the lower cover 20 during the upward/downward movement can be increased. The latch member 211 includes a guiding structure 212. In an exemplary embodiment, the guiding structure 212 mainly comprises a first channel 213, a second channel 214, and a curved channel 217 fluidly connected to the first channel 213 and the second channel 214. The first channel 213, the second channel 214, and the curved channel 217 extend into the latch member 211. However, the present invention is not limited to such configuration only.

The sealing ring 22 is made of a silicon material and is generally of a rectangular ring shape, which mainly comprises a connecting section 221 and a compressive deformation section 222 extended from the connecting section 221. The connecting section 221 is attached firmly onto the perimeter of the base plate 21. The compressive deformation section 222 extends toward a direction of the upper cover 10 and is formed at an outer side of the aforementioned retaining slanted surface 121.

The base plate 21 includes a lower mounting ring 23 formed at a location corresponding to the aforementioned upper mounting ring 13, and a locking slot 231 is formed at a central location of each edge plate of the lower mounting ring 23. The lower mounting ring 23 is mounted onto the aforementioned upper mounting ring 13 with each other. Each elastic hook 131 is able to move upward/downward inside each locking slot 231. In addition, a plurality of ribs 24 are formed between the outer perimeter of the lower mounting ring 23 and the base plate 21 in order to increase the structural strength.

The elastic unit 25 can be a torsion spring, which can be mounted at the outer perimeter of the aforementioned latch member 211 and can also be elastically clamped between the top plate 11 and the base plate 21.

The handle member 30 can be made of a plastic material, such as POM, and it mainly comprises a dial lever 31 and two arms 32 extended from the dial lever 21. Each arm 32 and the dial lever 31 can be integrally formed as one single piece via the injection molding formation method. Each arm 32 includes a shaft 321 connected thereto respectively, and each shaft 321 is received inside the aforementioned guiding structure 212. Similarly, the shaft 321 can be designed as a single shaft crossing each arm 32 directly.

Figure 5:
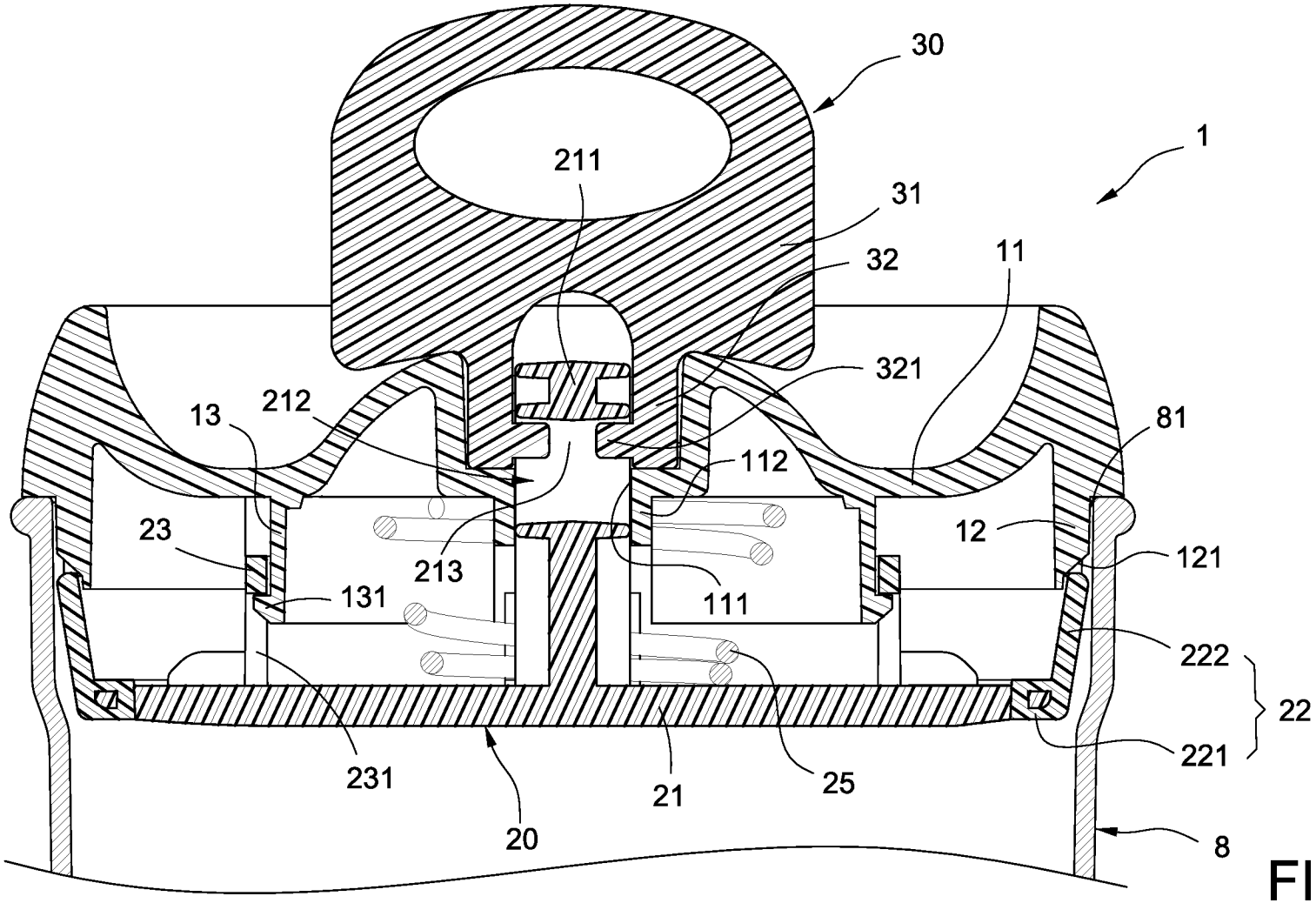
FIG. 5 is an assembly cross sectional view of the cap closing structure and the container of the present invention.
Figure 6:
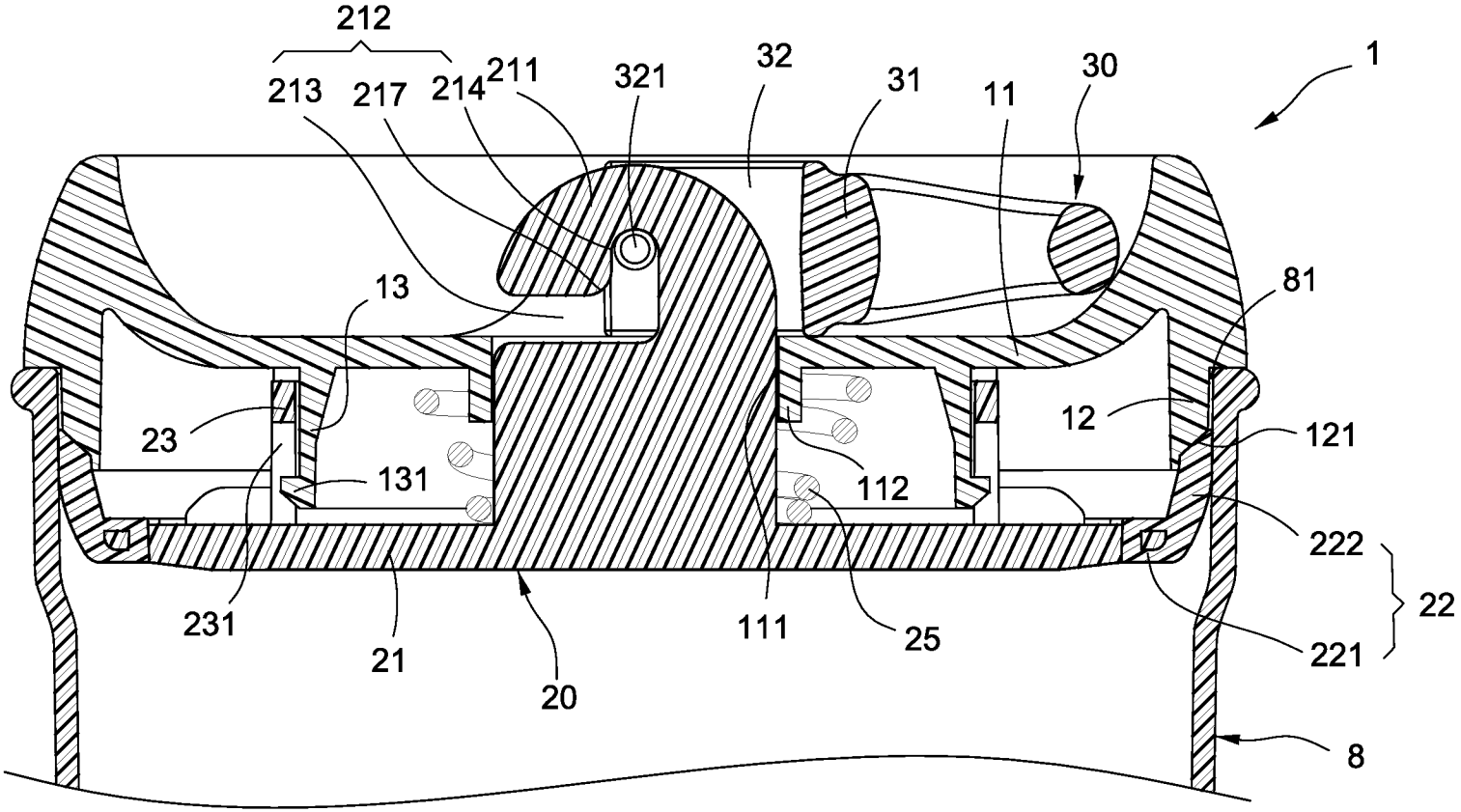
FIG. 6 is a cross sectional view showing a state of use of the cap closing structure and the container of the present invention.
Figure 7:
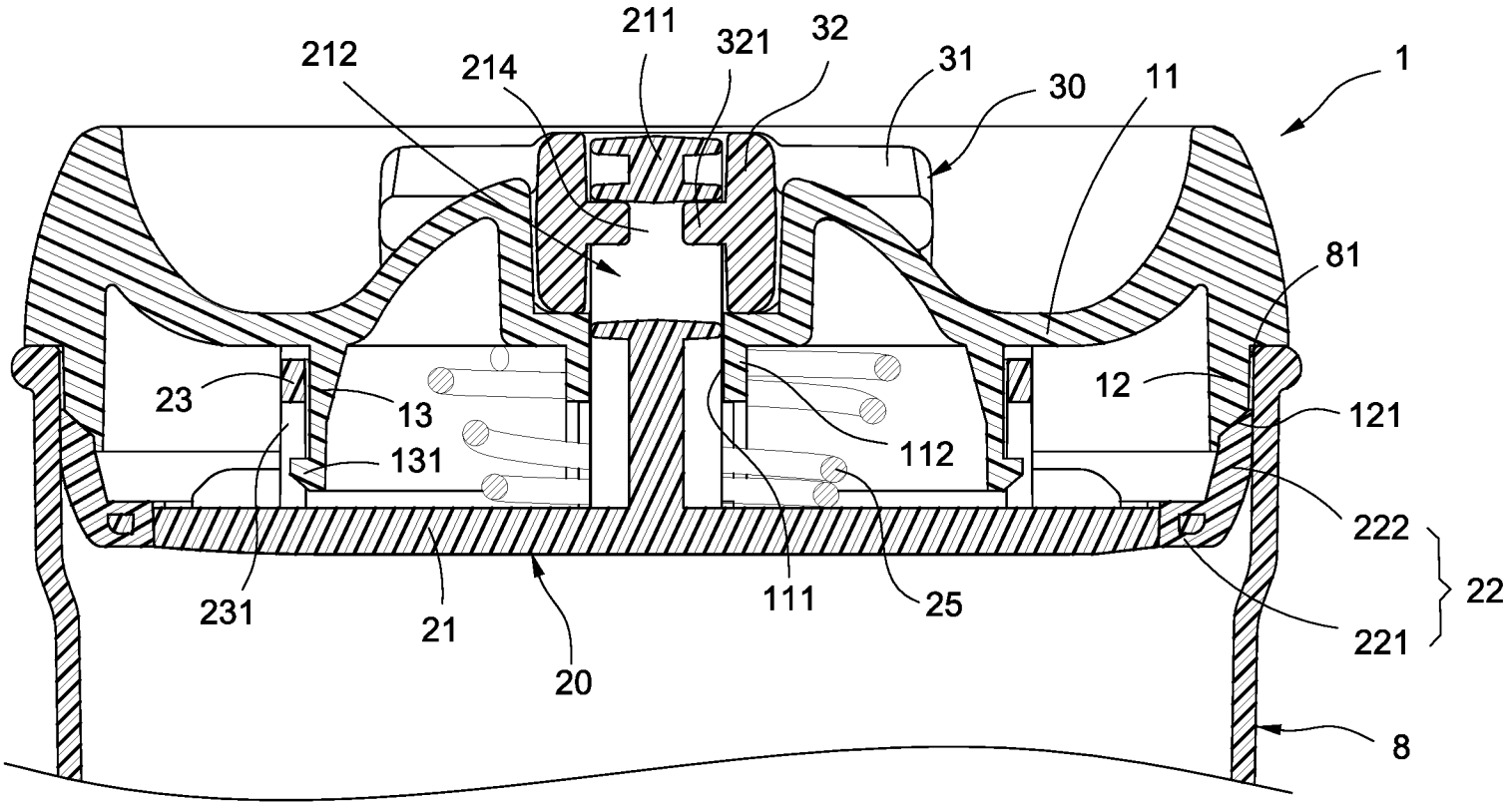
FIG. 7 is another cross-sectional view of the cap closing structure and the container of the present invention viewed from another angle.

Please refer to FIG. 5 to FIG. 7. The cap closing structure 1 of the present invention is used for attaching onto a container 8. The top portion of the container 8 is formed of an opening 81. The cap closing structure 1 is closed onto the opening 81 correspondingly. During the assembly, the dial lever 31 is at a vertical position, and the bottom surface of each arm 32 is in contact with the outer surface of the top plate 11. With the elastic element 25 being elastically clamped between the inner surface of the top plate 11 and the base plate 21, at this time, the shaft 321 is located at the top portion of the second channel 214. Under the elastic force exerted by the elastic element 25, the lower cover 20 is pushed to move toward a direction away from the upper cover 10, and each elastic hook 131 is still locked inside the locking slot 231 without any movement. At this time, the top edge of the compressive deformation section 222 of the sealing ring 22 is located underneath the retaining slanted surface 121 (as shown in FIG. 5).

During the operation, the dial lever 31 is dialed to rotate toward the horizontal direction, and the shaft 321 is rotated at the top portion of the second channel 214. The side surface of each arm 32 contacts with the outer surface of the top plate 11 (i.e. the distance between the side surface of the arm 32 and the shaft 321 being greater than the distance between the bottom surface of the arm 32 to the shaft 321 is utilized; in other words, a height difference is formed in the aforementioned relationship), and at this time, the lower cover 20 moves toward the direction of the upper cover 10. Since the circumferential wall 112 is mounted to surround the outer perimeter of the latch member 211, the lower cover 20 is able to be guided to move stably. In addition, the compressive deformation section 222 of the sealing ring 22 is then tightly sealed between the retaining slanted surface 12 and the inner wall of the container 8.

Figure 8:
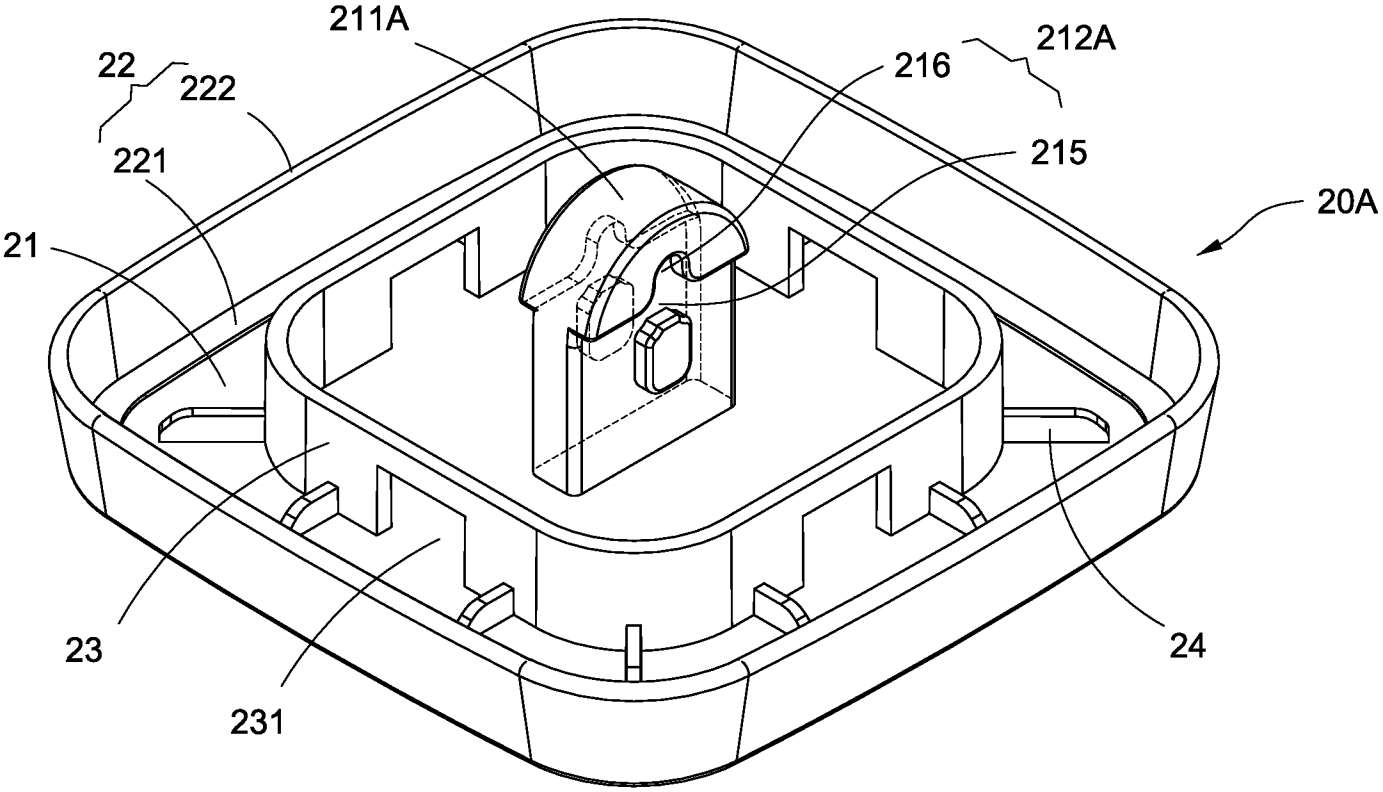
FIG. 8 is a perspective outer appearance view of a lower cover according to another embodiment of the present invention.

Please refer to FIG. 8. In addition to the aforementioned exemplary embodiments, the lower cover of the present invention can also be configured differently as described in the following. In another exemplary embodiment, the guiding structure 212A of the latch member 211A of the lower cover 20A mainly comprises a pair of first guiding channels 215 and a second guiding channel 216 fluidly connected to each one of the first guiding channels 215. In addition, each shaft 321 of the aforementioned each arm 32 is arranged corresponding to each one of the first guiding channels 215 and each one of the second guiding channels 216. Consequently, it is able to achieve effects equivalent to those of the aforementioned exemplary embodiment.

In view of the above, the cap sealing structure for a sealed container of the present invention is able to achieve the expected objectives and to overcome the drawbacks of prior arts. The above describes the preferable and feasible exemplary embodiments of the present invention for illustrative purposes only, which shall not be treated as limitations of the scope of the present invention. Any equivalent changes and modifications made in accordance with the scope of the claims of the present invention shall be considered to be within the scope of the claim of the present invention.

What is claimed is:

1. A cap closing structure for a sealed container, comprising:

an upper cover comprising a top plate and a circumferential bracket extended from the top plate, the top plate having a through hole formed thereon, the circumferential bracket having a retaining slanted surface formed thereon;

a lower cover arranged underneath the upper cover, the lower cover comprising a base plate and a sealing ring connected to the base plate, the base plate having a latch member extended to penetrate into the through hole, the latch member having a guiding structure formed thereon, the sealing ring having one end formed at another side of the retaining slanted surface;

an elastic element mounted onto an outer perimeter of the latch member and elastically clamped between the top plate and the bottom plate; and a handle member comprising a dial lever and an arm extended from the dial lever, the arm connected to a shaft, the shaft configured to operably move inside the guiding structure, thereby allowing the sealing ring to be tightly sealed between the retaining slanted surface and the container, wherein the latch member is non-detachable with the base plate, wherein the guiding structure comprises a first channel, a second channel, and a curved channel fluidly interconnecting the first channel and the second channel, and wherein the first channel, the second channel, and the curved channel extend into the latch member.

2. The cap closing structure for a sealed container, according to claim 1, wherein the through hole includes a circumferential wall extended from a perimeter thereof, and the outer perimeter of the latch member is configured to be surrounded by the circumferential wall.

3. The cap closing structure for a sealed container, according to claim 2, wherein an upper mounting ring is configured to extend between the circumferential wall and the circumferential bracket; a separation distance between the upper mounting ring and the circumferential bracket is smaller than a separation distance between the upper mounting ring and a central line of the top plate.

4. The cap closing structure for a sealed container, according to claim 2, wherein an upper mounting ring is configured to extend between the circumferential wall and the circumferential bracket; a lower mounting ring is configured to extend on the base plate at a location corresponding to the upper mounting ring; the lower mounting ring and the upper mounting ring are mounted onto each other.

5. The cap closing structure for a sealed container, according to claim 4, wherein the upper mounting ring includes a plurality of elastic hooks, the lower mounting rings includes a plurality of locking slots, and each one of the elastic hooks is locked onto each one of the locking slots correspondingly.

6. The cap closing structure for a sealed container, according to claim 4, wherein a plurality of ribs are formed between an outer perimeter of the lower mounting ring and the base plate.

7. The cap closing structure for a sealed container, according to claim 1, wherein the sealing ring comprises a connecting section and a compressive deformation section extended from the connecting section; the connecting section is configured to firmly attach onto a perimeter of the base plate; the compressive deformation section is configured to extend toward a direction of the upper cover and formed at an outer side of the retaining slanted surface.

8. The cap closing structure for a sealed container, according to claim 1, wherein the base plate and the sealing ring are integrally formed as one single piece via an injection molding formation method; the arm and the dial lever are also integrally formed as one single piece via an injection molding formation method.

* * * * *